US009308620B2

(12) United States Patent
Schutte et al.

(10) Patent No.: US 9,308,620 B2
(45) Date of Patent: Apr. 12, 2016

(54) PERMEATED GROOVING IN CMP POLISHING PADS

(71) Applicant: Texas Instruments Incorporated, Dallas, TX (US)

(72) Inventors: Christopher Lee Schutte, Garland, TX (US); Prakash Lakshmikanthan, Farmers Branch, TX (US)

(73) Assignee: TEXAS INSTRUMENTS INCORPORATED, Dallas, TX (US)

( * ) Notice: Subject to any disclaimer, the term of this patent is extended or adjusted under 35 U.S.C. 154(b) by 118 days.

(21) Appl. No.: 14/029,863

(22) Filed: Sep. 18, 2013

(65) Prior Publication Data

US 2015/0079886 A1 Mar. 19, 2015

(51) Int. Cl.
*B24B 37/26* (2012.01)
*B24B 37/24* (2012.01)

(52) U.S. Cl.
CPC ..... *B24B 37/26* (2013.01); *B24B 37/24* (2013.01)

(58) Field of Classification Search
CPC ..... B24B 37/26; B24B 37/16
USPC ..... 451/527, 285, 287
See application file for complete search history.

(56) References Cited

U.S. PATENT DOCUMENTS

| | | | | |
|---|---|---|---|---|
| 5,913,713 | A | 6/1999 | Cheek et al. | |
| 6,217,426 | B1 | 4/2001 | Tolles et al. | |
| 6,575,825 | B2 | 6/2003 | Tolles et al. | |
| 7,059,950 | B1 * | 6/2006 | Muldowney | 451/527 |
| 7,252,582 | B2 | 8/2007 | Renteln | |
| 7,807,252 | B2 * | 10/2010 | Hendron | B24B 37/26 428/167 |
| 8,062,103 | B2 | 11/2011 | Muldowney | |
| 8,137,166 | B2 | 3/2012 | Hsu et al. | |
| 8,192,257 | B2 | 6/2012 | Chandrasekaran et al. | |
| 8,287,793 | B2 | 10/2012 | Deopura et al. | |
| 2002/0068516 | A1 * | 6/2002 | Chen et al. | 451/285 |

* cited by examiner

*Primary Examiner* — Monica Carter
*Assistant Examiner* — Lauren Beronja
(74) *Attorney, Agent, or Firm* — Jacqueline J. Garner; Frank D. Cimino

(57) ABSTRACT

A polishing pad for polishing a semiconductor wafer or other materials, having grooves in the polishing pad to enhance the usable lifetime of the polishing pad.

6 Claims, 3 Drawing Sheets

PERMEATED GROOVING IN CMP POLISHING PADS

FIELD OF THE INVENTION

The present invention generally relates to the field of chemical mechanical polishing (CMP). More particularly, a CMP polishing pad having grooves arranged to improve polishing pad lifetime.

BACKGROUND OF THE INVENTION

In the fabrication of integrated circuits and other electronic devices, multiple layers of conducting, semiconducting and dielectric materials are deposited onto and removed from a surface of a semiconductor wafer. Thin layers of conducting, semiconducting and dielectric materials may be deposited using a number of deposition techniques. Common deposition techniques in modem wafer processing include physical vapor deposition (PVD), also known as sputtering, chemical vapor deposition (CVD), plasma-enhanced chemical vapor deposition (PECVD) and electrochemical plating, among others. Common removal techniques include wet and dry isotropic and anisotropic etching, among others.

As layers of materials are sequentially deposited and removed, the uppermost surface of the wafer becomes non-planar. Because subsequent semiconductor processing (e.g., metallization) requires the wafer to have a flat surface, the wafer needs to be planarized. Planarization is useful for removing undesired surface topography and surface defects, such as rough surfaces, agglomerated materials, crystal lattice damage, scratches and contaminated layers or materials.

Chemical mechanical planarization, or chemical mechanical polishing (CMP), is a common technique used to planarize work pieces such as semiconductor wafers. In conventional CMP, a wafer carrier, or polishing head, is mounted on a carrier assembly. The polishing head holds the wafer and positions the wafer in contact with a polishing layer of a polishing pad within a CMP apparatus. The carrier assembly provides a controllable pressure between the wafer and polishing pad. Simultaneously therewith, a slurry, or other polishing medium, is flowed onto the polishing pad and into the gap between the wafer and polishing layer. To effect polishing, the polishing pad and wafer are moved, typically rotated, relative to one another. The wafer surface is polished and made planar by chemical and mechanical action of the polishing layer and polishing medium on the surface. As the polishing pad rotates beneath the wafer, the wafer sweeps out a typically annular polishing track, or polishing region, wherein the wafer surface directly confronts the polishing layer.

Important considerations in designing a polishing layer include the distribution of polishing medium across the face of the polishing layer, the flow of fresh polishing medium into the polishing track, the flow of used polishing medium from the polishing track and the amount of polishing medium that flows through the polishing zone essentially unutilized, among others. One way to address these considerations is to provide the polishing layer with grooves. Over the years, quite a few different groove patterns and configurations have been implemented. Prior art groove patterns include radial, concentric-circular, Cartesian-grid, straight line, random and spiral, patterns among others. Prior art groove configurations include configurations wherein the depth of all the grooves are uniform among all grooves and configurations wherein the depth of the grooves varies from one groove to another.

It is generally acknowledged among CMP practitioners that certain groove patterns and depths result in higher slurry consumption and shorter polishing pad life than others to achieve comparable material removal rates. Circular grooves, which do not connect to the outer periphery of the polishing layer, tend to consume less slurry than radial grooves, which provide the shortest possible path for slurry to reach the pad perimeter under the centrifugal forces resulting from the rotation of the pad. Cartesian grids of grooves, which provide paths of various lengths to the outer periphery of the polishing layer, hold an intermediate position.

Various groove patterns have been disclosed in the prior art that attempt to reduce slurry consumption and maximize slurry retention time on the polishing layer. For example, U.S. Pat. No. 6,241,596 to Osterheld et al. discloses a rotational-type polishing pad having grooves defining zigzag channels that generally radiate outward from the center of the pad. In one embodiment, the Osterheld et al. pad includes a rectangular "x-y" grid of grooves. The zigzag channels are defined by blocking selected ones of the intersections between the x- and y-direction grooves, while leaving other intersections unblocked. In another embodiment, the Osterheld et al. pad includes a plurality of discrete, generally radial zigzag grooves. Generally, the zigzag channels defined within the x-y grid of grooves or by the discrete zigzag grooves inhibit the flow of slurry through the corresponding grooves, at least relative to an unobstructed rectangular x-y grid of grooves and straight radial grooves. Another prior art groove pattern that has been described as providing increased slurry retention time is a spiral groove pattern that is assumed to push slurry toward the center of the polishing layer under the force of pad rotation.

Consumables are the highest cost in CMP processing. Topping the list behind slurries are CPM polishing pads which are replaced when the pad wears to the point that the polish process becomes compromised. There is a need for a polishing pad that has an extended life over current polishing pads.

SUMMARY OF THE INVENTION

The following presents a simplified summary in order to provide a basic understanding of one or more aspects of the invention. This summary is not an extensive overview of the invention, and is neither intended to identify key or critical elements of the invention, nor to delineate the scope thereof. Rather, the primary purpose of the summary is to present some concepts of the invention in a simplified form as a prelude to a more detailed description that is presented later.

In accordance with an embodiment of the present invention, a CMP polishing pad is provided. The CMP polishing pad, comprises: a CMP polishing layer, including a polishing pad configured to polish a surface of at least one of a magnetic, optical or semiconductor substrate in the presence of a polishing medium, the polishing layer including a rotational axis, an outer periphery and an annular polishing track concentric with the rotational axis, wherein the polishing pad has a top surface, a bottom surface and a thickness; a plurality of grooves formed in the polishing pad comprising first and second sets of grooves located entirely within the polishing pad; the first set of grooves located on the top surface of the polishing pad, has a pattern and vertically penetrates into the top surface of polishing pad to at least 50% of the polishing pad thickness; and the second set of grooves is located on the bottom surface of the polishing pad, has a pattern identical to the pattern of the first set of grooves and vertically penetrates into the bottom surface of polishing pad to at least 50% of the polishing pad thickness; and wherein the first set of grooves is located between and interlaced at the interior ends, without any intersections between the first and second set of grooves, and are configured to present a continuous groove to the material being polished from the top of the pad to within 6 percent of the bottom of the polishing pad.

In accordance with another embodiment of the present invention, a CMP polishing pad is provided. The CMP polishing pad, comprises: a CMP polishing layer, including a polishing pad configured to polish a surface of at least one of a magnetic, optical or semiconductor substrate in the presence of a polishing medium, the polishing layer including a rotational axis, an outer periphery and an annular polishing track concentric with the rotational axis, wherein the polishing pad has a top surface, a bottom surface and a thickness; a plurality of grooves formed in the polishing pad comprising first, second and third sets of grooves located entirely within the polishing pad; the first set of grooves located on the top surface of the polishing pad, has a pattern and vertically penetrates into the top surface of polishing pad to at least 37% of the polishing pad thickness; the second set of grooves is located on the bottom surface of the polishing pad, has a pattern identical to the pattern of the first set of grooves and vertically penetrates into the bottom surface of polishing pad to at least 37% of the polishing pad thickness; and wherein the first set of grooves is located in direct alignment at the interior ends, with the second set of grooves; and the third set of grooves is centered between the top surface of the polishing pad and the bottom surface of the polishing pad and located between and interlaced with the aligned interior ends of the first and second groves, and are configured to present a continues groove to the material being polished from the top of the pad to within 6 percent of the bottom of the polishing pad.

In accordance with a further embodiment of the present invention, a polishing pad is provided. The polishing pad, comprising: a polishing layer configured to polish a surface of at least one of a magnetic, optical or semiconductor substrate in the presence of a polishing medium, the polishing layer including: a rotational axis; an outer periphery; an annular polishing track concentric with the rotational axis; and a peripheral region located between the annular polishing track and the outer periphery; and a plurality of grooves formed in the polishing layer, having top and bottom surfaces, and comprising: the plurality of grooves formed in the polishing pad comprising first and second sets of grooves located entirely within the polishing pad; the first set of grooves located on the top surface of the polishing pad, has a pattern and vertically penetrates into the top surface of polishing pad to at least 50% of the polishing pad thickness; and the second set of grooves is located on the bottom surface of the polishing pad, has a pattern identical to the pattern of the first set of grooves and vertically penetrates into the bottom surface of polishing pad to at least 50% of the polishing pad thickness; and wherein the first set of grooves is located between and interlaced at the interior ends, without any intersections between the first and second set of grooves, and are configured to present a continues groove to the material being polished from the top of the pad to within 6 percent of the bottom of the polishing pad.

In accordance with a further embodiment of the present invention, a polishing pad is provided. The polishing pad, comprising: a polishing layer configured to polish a surface of at least one of a magnetic, optical or semiconductor substrate in the presence of a polishing medium, the polishing layer including: a rotational axis; an outer periphery; an annular polishing track concentric with the rotational axis; and a peripheral region located between the annular polishing track and the outer periphery; and a plurality of grooves formed in the polishing layer, having top and bottom surfaces, and comprising: the plurality of grooves formed in the polishing pad comprising first, second and third sets of grooves located entirely within the polishing pad; the first set of grooves located on the top surface of the polishing pad, has a pattern and vertically penetrates into the top surface of polishing pad to at least 37% of the polishing pad thickness; the second set of grooves is located on the bottom surface of the polishing pad, has a pattern identical to the pattern of the first set of grooves and vertically penetrates into the bottom surface of polishing pad to at least 37% of the polishing pad thickness; and wherein the first set of grooves is located in direct alignment at the interior ends, with the first set of grooves; and the third set of grooves is centered between the top surface of the polishing pad and the bottom surface of the polishing pad and located between and interlaced with the aligned interior ends of the first and second groves, and are configured to present a continues groove to the material being polished from the top of the pad to within 6 percent of the bottom of the polishing pad.

DESCRIPTION OF THE VIEWS OF THE DRAWING

In the drawings, like reference numerals are sometimes used to designate like structural elements. It should also be appreciated that the depictions in the figures are diagrammatic and not to scale.

DETAILED DESCRIPTION OF EXAMPLE EMBODIMENTS

The present invention is described with reference to the attached figures. The figures are not drawn to scale and they are provided merely to illustrate the invention. Several aspects of the invention are described below with reference to example applications for illustration. It should be understood that numerous specific details, relationships, and methods are set forth to provide an understanding of the invention. One skilled in the relevant art, however, will readily recognize that the invention can be practiced without one or more of the specific details or with other methods. In other instances, well-known structures or operations are not shown in detail to avoid obscuring the invention. The present invention is not limited by the illustrated ordering of acts or events, as some acts may occur in different orders and/or concurrently with other acts or events. Furthermore, not all illustrated acts or events are required to implement a methodology in accordance with the present invention.

Figure 1:
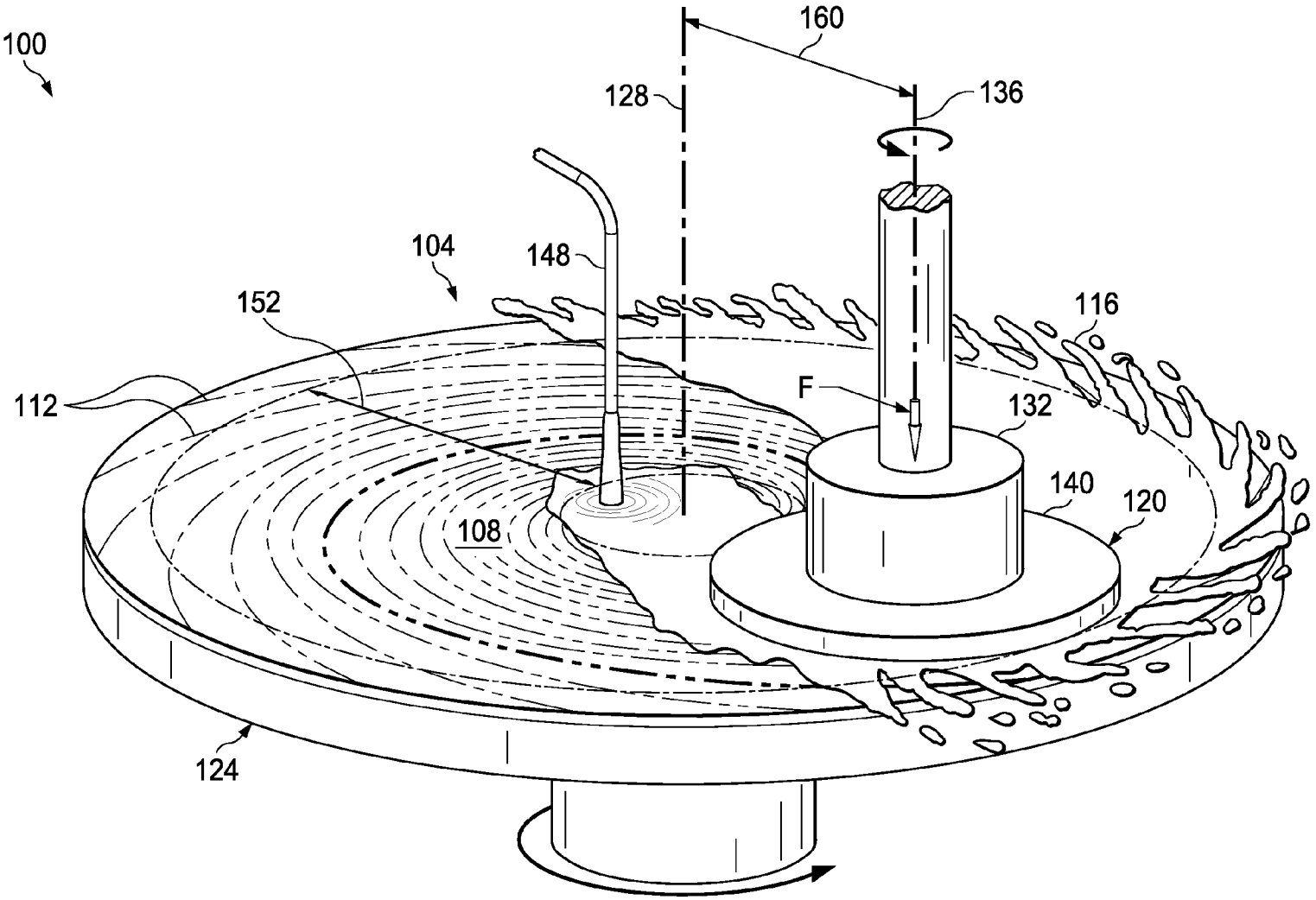
FIG. 1 is a partial perspective view of a chemical mechanical polishing (CMP) system of the present invention.

Referring now to the drawings, FIG. 1 shows in accordance with the present invention a chemical mechanical polishing (CMP) system, which is generally denoted by the numeral 100. CMP system 100 includes a polishing pad 104 having a polishing layer 108 that includes a plurality of grooves 112 arranged and configured for improving the utilization of a polishing medium 116 applied to the polishing pad during polishing of a semiconductor wafer 120 or other work pieces, such as glass, silicon wafers and magnetic information storage disks, among others. For convenience, the term "wafer" is used in the description below. However, those skilled in the art will appreciate that work pieces other than wafers are within the scope of the present invention. Polishing pad 104 and its unique features are described in detail below.

CMP system 100 may include a polishing platen 124 rotatable about an axis 128 by a platen driver (not shown). Platen 124 may have an upper surface on which polishing pad 104 is mounted. A wafer carrier 132 rotatable about an axis 136 may be supported above polishing layer 108. Wafer carrier 132 may have a lower surface that engages wafer 120. Wafer 120 has a surface 140 that confronts polishing layer 108 and is planarized during polishing. Wafer carrier 132 may be supported by a carrier support assembly (not shown) adapted to rotate wafer carrier 132 and attached wafer 120 and provide a downward force F to press wafer surface 140 against polishing layer 108 so that a desired pressure exists between the wafer and the polishing layer during polishing.

CMP system 100 may also include a supply system for supplying polishing medium 116 to polishing layer 108. Supply system may include a reservoir (not shown), e.g., a temperature controlled reservoir, that holds polishing medium 116. A conduit 148 may carry polishing medium 116 from the reservoir to a location adjacent polishing pad 104 where the polishing medium is dispensed onto polishing layer 108. A flow control valve (not shown) may be used to control the dispensing of polishing medium 116 onto pad 104.

During the polishing operation, the platen driver rotates platen 124 and polishing pad 104 and the supply system is activated to dispense polishing medium 116 onto the rotating polishing pad. Polishing medium 116 spreads out over polishing layer 108 due to centrifugal force caused by the rotation of polishing pad 104, including the gap between wafer 120 and polishing pad 104. The wafer carrier 132 may be rotated at a selected speed, e.g., 0 rpm to 150 rpm, so that wafer surface 140 moves relative to the polishing layer 108. The wafer carrier 132 may also be controlled to provide a downward force F so as to induce a desired pressure, e.g., 0 psi to 15 psi, between wafer 120 and polishing pad 104. Polishing platen 124 is typically rotated at a speed of 0 to 150 rpm. As polishing pad 104 is rotated beneath wafer 120, surface 140 of the wafer sweeps out a typically annular wafer track, or polishing track 152 on polishing layer 108.

It is noted that under certain circumstances polishing track 152 may not be strictly annular. For example, if surface 140 of wafer 120 is longer in one dimension than another and the wafer and polishing pad 104 are rotated at particular speeds such that these dimensions are always oriented the same way 152 would be generally annular, but have a width that varies from the longer dimension to the shorter dimension. A similar effect would occur at certain rotational speeds if surface 140 of wafer 120 were bi-axially symmetric, as with a circular or square shape, but the wafer is mounted off-center relative to the rotational center of that surface. Yet another example of when polishing track 152 would not be entirely annular is when wafer 120 is oscillated in a plane parallel to polishing layer 108 and polishing pad 104 is rotated at a speed such that the location of the wafer due to the oscillation relative to the polishing layer is the same on each revolution of the pad. In all of these cases, which are typically exceptional, polishing track 152 is still annular in nature, such that they are considered to fall within the coverage of the term "annular".

Figure 2:
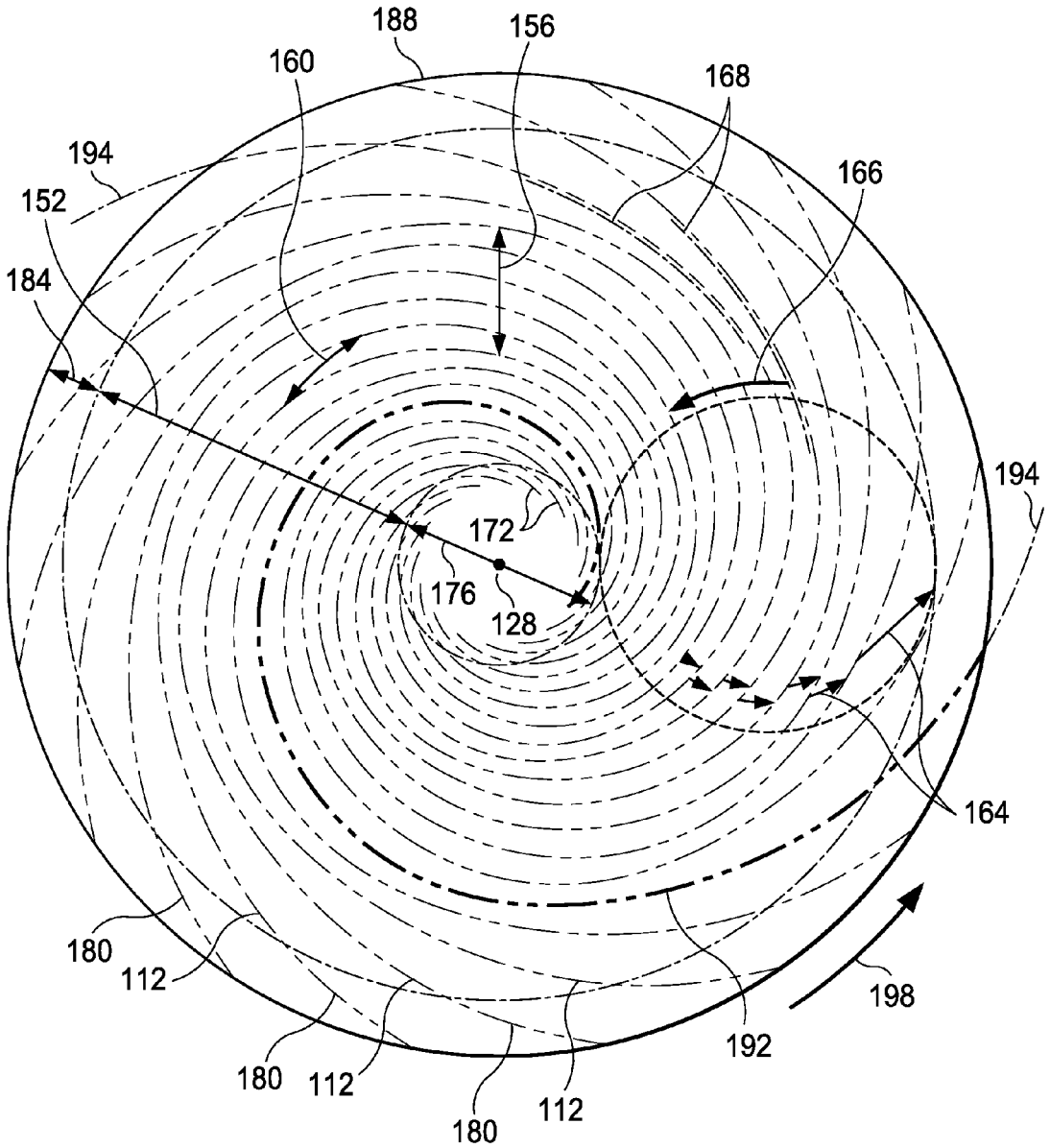
FIG. 2 is a plan view of the polishing pad of FIG. 1.

FIG. 2 illustrates polishing pad 104 of FIG. 1 in more detail. Spiral grooves 112 are arranged within polishing track 152 for illustration purposes only. Groves may be radial, concentric-circular, Cartesian-grid, straight line, random or spiral patterns, among others so that they are spaced from one another in both a radial direction 156 and a circumferential direction 160 relative to the rotational nature of polishing pad 104. During polishing, the polishing medium, e.g., polishing medium 116 of FIG. 1, moves from groove to groove within polishing track 152 (as illustrated by arrows 164) primarily only under the influence of wafer 120 as the wafer is rotated in confronting relationship with polishing pad 104, e.g., in rotational direction 166. Since the polishing medium generally moves only when wafer 120 is present, the polishing medium tends to be utilized more efficiently with conventional pads, having grooves that extend uninterrupted through the polishing track. This is so because a polishing medium often flows through the polishing track in these uninterrupted grooves under the centrifugal influence of the rotation of the pad regardless of whether or not the wafer is present.

In addition to grooves 112 being spaced from one another radially and circumferentially, it is desirable that at least a portion of the longitudinal axis 168 of each groove be oriented non-circumferentially relative to polishing pad 104. In other words, it is desirable that longitudinal axes 168 of grooves 112 not be merely arcs of circles concentric with rotational axis 128 of polishing pad 104. Providing such grooves 112 can facilitate the flow of a polishing medium as polishing pad 104 is rotated due to the effects of centrifugal forces caused by the rotation. In the present example, grooves 112 are generally arcs of spirals and, therefore, are non-circumferential along their entire lengths. In some, but not necessarily all, groove arrangements of the present invention, it is desirable that the distance between endpoints of each groove along a straight line connecting the endpoints be less than the least dimension of the surface of the substrate being polished that extends through the rotational center of that surface. For example, for a circular surface rotated about its concentric center, the straight-line distance between the endpoints of each groove using this criterion would be a value less than the diameter of the surface. On the other hand, for a rectangle having long sides of length L and short sides of length S, under this criterion the straight line distance between the endpoints of a groove would be a value less than the short side length S.

Grooves 112 may also include a subset 172 located partially in a central region 176 of polishing layer 108 radially inward of polishing track 152 and partially in the polishing track. This subset 172 of grooves 112 is useful, e.g., in the context of polishing systems, such as CMP system 100 of FIG. 1, in which a polishing medium is dispensed into central region 176, for enhancing the flow of the polishing medium from the central region into polishing track 152. In addition, grooves 112 may include a subset 180 of grooves that extend from polishing track 152 to a peripheral region 184 (if any) radially outward of the polishing track. Grooves 112 in subset 180 may also extend to the peripheral edge 188 of polishing pad 104, if desired. Subset 180 of grooves 112 is useful, e.g., for enhancing the flow of the polishing medium out of polishing track 152.

In general CMP processes use a thin polishing pad in the range of 80 to 120 thousandths of an inch (mils) that can be mated with a sub pad. Grooves are manufactured into the pad providing a delivery path for fresh slurry and an exit path for the process effluent, wherein the grooves can be machined by a laser or by mechanical means. When the pad wears thin and grooves become shallow, the delivery and exit paths become compromised resulting in lower removal rates, thus decreasing throughput. Shallow pad grooves can cause other issues such as increased defectivity and increased non-uniformity.

A CMP polishing pad is typically a circular disc. The polishing pad is typically composed of a material selected from a group comprised of a polyurethane, a polycarbonate, a nylon, an acrylic polymer, or a polyester. A CMP polishing pad may or may not have a sub pad.

Figure 3:
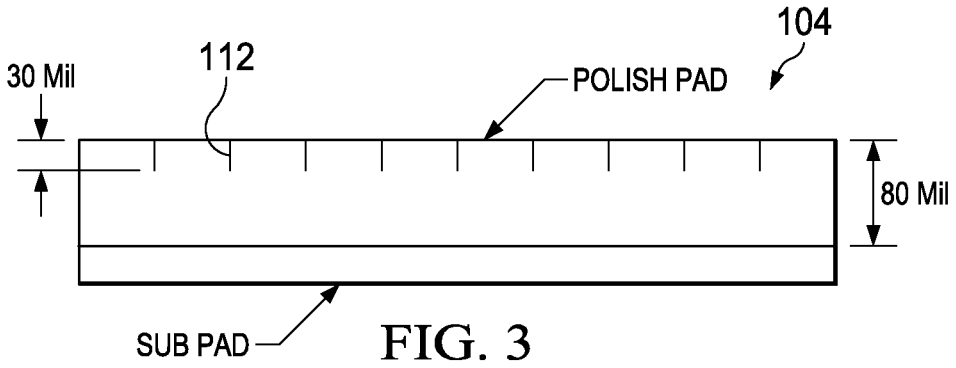
FIG. 3 is an illustration of a typical polishing pad of the present invention.

As will become readily apparent from FIG. 3, grooves 112 may have any of a wide variety of arrangements and configurations. Here the grooves are shown of a depth approximately equal to 37.5% of the pad thickness or 30 mils in an 80 mil pad, wherein the cross sectional shape of the grooves as rectangular. While these represent preferred embodiments, both the depth of the grooves and their cross-sectional shapes can differ from the figure, and can vary within a given pad. The polishing pad grooves can be between 14 and 30 mils wide and the shape of the grooves can be rectangular.

Figure 3A:
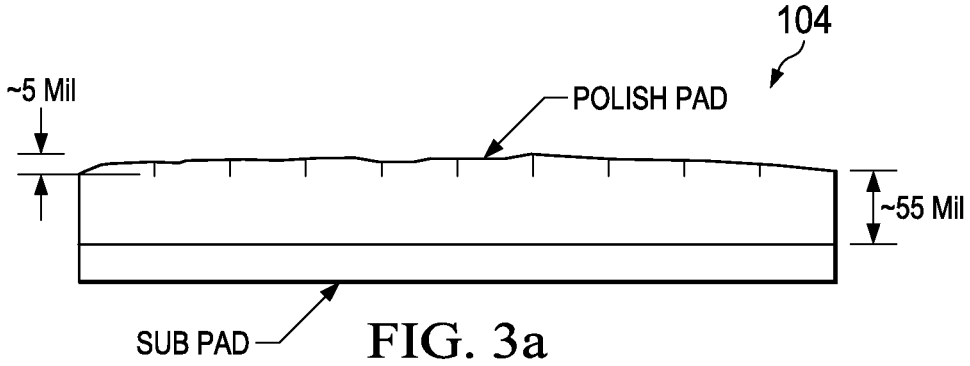
FIG. 3*a* is an illustration of a typical polishing pad worn to the point that the polish process has become compromised.

The topographical surface arrangement of the grooves can vary depending on the processing equipment and the material being polished. Surface patterns can be chosen from a group comprised of radial, concentric-circular, Cartesian-grid, straight line, random or spiral patterns, When the polishing pad wears thin and grooves become shallow as shown in FIG. 3*a*, the delivery and exit paths become compromised resulting in lower removal rates, thus decreasing throughput. Shallow pad grooves can cause other issues such as increased defectivity and increased non-uniformity. Typically, the polishing pad must be replaced when a minimum of 5 mils of the grooves 112 are remaining.

However, in FIG. 2 grooves 112 are arranged end-to-end in groups 192 so that the grooves in each group extend along a corresponding smooth path, in this case a spiral path 194, that extends from central region 176, through polishing track 152 and to peripheral edge 188. As those skilled in the art will appreciate, groups 192 of grooves 112 may be arranged in a radial, concentric-circular, Cartesian-grid, straight line, random or spiral patterns, among others in a similar manner, wherein the shapes and orientations, are angled into or away from the design rotational direction 198 of polishing pad 104, circularly arced and generally radial into or away from the design rotational direction 198 of polishing pad 104, circularly arced and generally radial, circularly arced and non-radial, among many others.

The purpose of the present invention is to manufacture pads with grooves through the entire thickness of the polish pad, allowing significantly more of the pad to be consumed. Overlap between the grooves ensures that transition.

Figure 4:
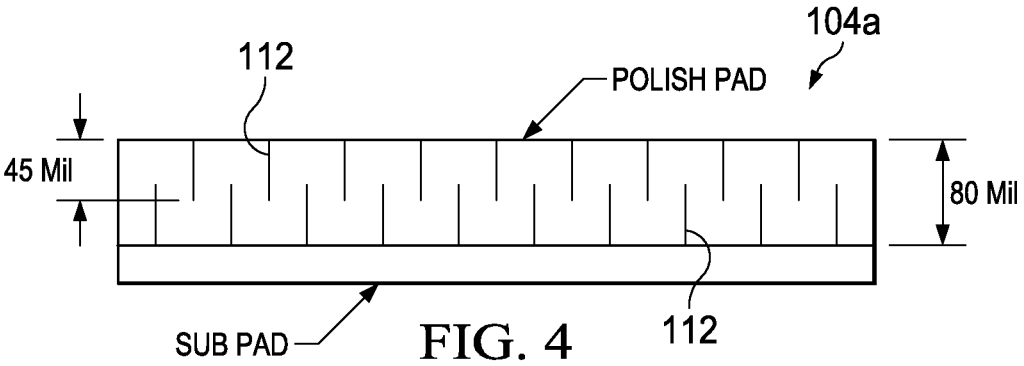
FIGS. 4 and 5 show the cross-section of polishing pads in accordance with embodiments of the present invention.

FIG. 4 shows a first embodiment of the present invention. The CMP polishing pad has 2 sets of grooves that exceed 50% of the pad thickness on both the top and bottom surface of the pad wherein the top and bottom grooves are interlaced at the interior ends and present a continues groove to the material being polished from the top of the pad to within 6 percent of the bottom of the polishing pad where Shallow pad grooves can cause other issues such as increased defectivity and increased non-uniformity Current pad usage of a typical pad before replacement of the pad is required is about 30% wherein usage of the pad disclosed in the present invention is 91% or 3 to 1 increase in pad life time.

Figure 5:
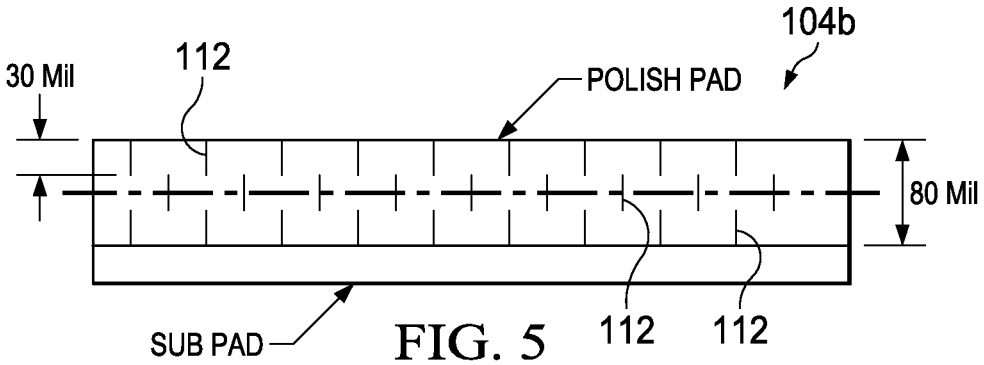

FIG. 5 shows a second embodiment of the present invention. The CMP polishing pad has 3 sets of grooves that exceed 37% of the pad thickness on both the top and bottom surfaces of the pad and the center of the pad, and wherein the top and bottom grooves are directly in line at the interior ends and the center grooves are centered between the top and bottom surfaces of the pad and interlaced at the interior ends of the top and bottom grooves and present a continues groove to the material being polished from the top of the pad to within 6 percent of the bottom of the polishing pad where Shallow pad grooves can cause other issues such as increased defectivity and increased non-uniformity.

Multiple grooving methods such as grooving from the back side of the pad, mid-pad manufacturing process grooving, multiple pad layers, molding, and 3D printing could be employed to achieve the disclosed pad grooving.

While various embodiments of the present invention have been described above, it should be understood that they have been presented by way of example only and not limitation. Numerous changes to the disclosed embodiments can be made in accordance with the disclosure herein without departing from the spirit or scope of the invention. Thus, the breadth and scope of the present invention should not be limited by any of the above described embodiments. Rather, the scope of the invention should be defined in accordance with the following claims and their equivalents.

What is claimed is:

1. A CMP polishing pad, comprising:

a CMP polishing layer, including a polishing pad configured to polish a surface of at least one of a magnetic, optical or semiconductor substrate in the presence of a polishing medium, the polishing layer including a rotational axis, an outer periphery and an annular polishing track concentric with the rotational axis, wherein the polishing pad has a top surface, a bottom surface and a thickness between the top surface and the bottom surface;

a plurality of grooves formed in the polishing pad comprising first, second and third sets of grooves located entirely within the polishing pad;

the first set of grooves located on the top surface of the polishing pad, has a pattern and vertically penetrates into the top surface of polishing pad to at least 37% of the polishing pad thickness;

the second set of grooves is located on the bottom surface of the polishing pad, has a pattern identical to the pattern of the first set of grooves and vertically penetrates into the bottom surface of polishing pad to at least 37% of the polishing pad thickness; and wherein the first set of grooves is located in direct alignment at the interior ends, with the second set of grooves; and the third set of grooves is centered between the top surface of the polishing pad and the bottom surface of the polishing pad and located between and interlaced with the aligned interior ends of the first and second groves, and are configured to present a continuous groove to the material being polished from the top of the pad to within 6 percent of the bottom of the polishing pad.

2. The CMP polishing pad of claim 1, wherein the polishing pad is composed of a material selected from the group comprising: a polyurethane, a polycarbonate, a nylon, an acrylic polymer, or a polyester.

3. The CMP polishing pad of claim 1, wherein the polishing pad pattern is selected from the group comprising: radial, concentric-circular, Cartesian-grid, straight line, random or spiral patterns.

4. A polishing pad, comprising:

a polishing layer configured to polish a surface of at least one of a magnetic, optical or semiconductor substrate in the presence of a polishing medium, the polishing layer including:

a rotational axis;

an outer periphery;

an annular polishing track concentric with the rotational axis; and a peripheral region located between the annular polishing track and the outer periphery; and a plurality of grooves formed in the polishing layer, having top and bottom surfaces, and comprising:

the plurality of grooves formed in the polishing pad comprising first, second and third sets of grooves located entirely within the polishing pad;

the first set of grooves located on the top surface of the polishing pad, has a pattern and vertically penetrates into the top surface of polishing pad to at least 37% of the polishing pad thickness;

the second set of grooves is located on the bottom surface of the polishing pad, has a pattern identical to the pattern of the first set of grooves and vertically penetrates into the bottom surface of polishing pad towards the top surface to at least 37% of the polishing pad thickness; and wherein the first set of grooves is located in direct alignment at the interior ends, with the first set of grooves; and the third set of grooves is centered between the top surface of the polishing pad and the bottom surface of the polishing pad and located between and interlaced with the aligned interior ends of the first and second groves, and are configured to present a continuous groove to the material being polished from the top of the pad to within 6 percent of the bottom of the polishing pad.

5. The polishing pad of claim 4, wherein the polishing pad is composed of a material selected from the group comprising: a polyurethane, a polycarbonate, a nylon, an acrylic polymer, or a polyester.

6. The polishing pad of claim 4, wherein the polishing pad pattern is selected from the group comprising: radial, concentric-circular, Cartesian-grid, straight line, random or spiral patterns.

* * * * *